US005184905A

United States Patent [19]

Buschmann et al.

[11] Patent Number: 5,184,905

[45] Date of Patent: Feb. 9, 1993

[54] DEVICE FOR THE TRANSPORT OF PAPER IN PRINTERS, PARTICULARLY DOT MATRIX PRINTERS

[75] Inventors: Ulrich Buschmann, Elchingen; Günter Gomoll, Neisingen/Leibi; Wolfgang Hauslaib, Langenau; Kurt Röhrer, Niederstotzingen, all of Fed. Rep. of Germany

[73] Assignee: Mannesmann Aktiengesellschaft, Dusseldorf, Fed. Rep. of Germany

[21] Appl. No.: 588,081

[22] Filed: Sep. 25, 1990

[30] Foreign Application Priority Data

Sep. 29, 1989 [DE] Fed. Rep. of Germany ..... 3933033

[51] Int. Cl.[5] ..... B41J 11/00

[52] U.S. Cl. ..... 400/616.1; 400/616.2

[58] Field of Search ..... 400/616, 616.1, 616.2, 400/619; 226/74, 75, 83, 84, 85, 86

[56] References Cited

U.S. PATENT DOCUMENTS

| | | | |
|---|---|---|---|
| 4,032,727 | 6/1977 | Burns, Jr. | 179/178 |
| 4,571,103 | 2/1986 | Takeo et al. | 400/616.1 |
| 4,815,877 | 3/1989 | Kikuchi et al. | 400/619 |
| 4,828,157 | 5/1989 | Yokoi | 400/616 |
| 4,979,837 | 12/1990 | Koike | 400/616.1 |

FOREIGN PATENT DOCUMENTS

| | | | |
|---|---|---|---|
| 2043 | 1/1980 | Japan | 400/616.1 |
| 240472 | 11/1985 | Japan | 400/29 |
| 82058 | 4/1987 | Japan | 400/616.1 |

*Primary Examiner*—David A. Wiecking
*Assistant Examiner*—Ren Yan
*Attorney, Agent, or Firm*—Cohen, Pontani, Lieberman, Pavane

[57] ABSTRACT

A paper transport device in printers (1), particularly in dot matrix printers, for the feeding of continuous webs (6) by transversely displaceable tractors (7, 8) which are arranged in pairs on the printer frame. The tractor pins (9) engage into the edge perforations of the continuous web (6) and the pin belts (10) are guided over at least one wheel (11) of the tractor (7, 8) and at least one driven tractor wheel (13) is present. The device is equipped with a locking device so that the tractor (7, 8) operating as push means or as pull means is mounted in each case on a drive shaft (14) and in each case prevented from turning on the printer fram (1*a*) by a projection (16) on the side (15*a*) opposite the drive shaft (14) or by a swingable tractor flap (24).

9 Claims, 5 Drawing Sheets

DEVICE FOR THE TRANSPORT OF PAPER IN PRINTERS, PARTICULARLY DOT MATRIX PRINTERS

FIELD OF THE INVENTION

The present invention relates to a device for the transport of paper in printers, particularly dot matrix printers, for the feeding of continuous webs by means of transversely displaceable tractors arranged in pairs on the frame of the printer. The pins of the tractors engage in the edge perforations of continuous paper, the pin belts are guided over at least one wheel of the tractor and at least one driven tractor wheel is present.

BACKGROUND AND SUMMARY OF THE INVENTION

Such pairs of tractors are used as pull tractors or as push tractors. Pull tractors pull the web of paper from a supply container over the printing platen out of the printer and are, therefore, arranged behind the printing platen as viewed in the direction of transport. Push tractors, on the other hand, push the paper taken from the supply container via guide channels to the printing platen and push it further through guides out of the printer and are therefore arranged in front of the printing platen as seen in the direction of transport. The pushing forward of the paper entails fewer problems in the case of single sheets than in the case of multi-layer continuous webs. It can, therefore, be advantageous upon feeding paper from the bottom to the printer, to use not a push tractor but rather a pull tractor. A printer, however, is rarely equipped with both types of tractors since the presence of both types would increase the cost of manufacture. On the other hand, the construction of the printer also becomes more complicated in the event that both types of tractors are provided.

In U.S. Pat. No. 4,571,103, it has already been suggested to use only one pair of tractors which can be aligned tangentially, by a swinging and locking device, both with the top side of a cylindrical printing platen and with the bottom side of the printing platen. Depending on the position, such a swingable tractor acts as a push tractor or as a pull tractor. This solution with only one pair of tractors requires, however, the swinging and locking device. It must also be kept in mind here that the operator must adjust the pair of tractors, which is not always advantageous in the case of technically untrained personnel.

In contrast to the known technique, the present invention proceeds from a standard development of the printer which provides a fixedly installed pair of tractors as push means for edge-perforated continuous webs. The tractor pair is specifically designed so that the same tractor pair can be utilized as push tractor or as pull tractor. Thus, a printer may be provided with one or the other or both.

One object of the present invention is to thus provide a locking device or means for holding in place the pair of tractors both for the push tractor and for the pull tractor embodiment.

This object is attained in accordance with the present invention for one of the types of tractor operation or tractor arrangements by mounting each tractor acting as push means on a drive shaft and by preventing the tractor in each case from turning by means of a projection provided on the tractor frame on the side opposite the drive shaft, which projection engages in a suitable guide in the printer frame. This one-sided prevention from turning permits a simple fixing in position of the pair of tractors for push operation and nevertheless permits the transverse displacement of the tractors according to the width of paper selected.

In a further development of the invention, the projections of both tractors are held on the printer frame in a continuous guide which extends parallel to the drive shaft.

In yet a further development of the present invention the projections are provided, for locking purposes, with a plurality of teeth on the side of the projection which rests against the guide and which teeth engage in similar teeth provided on the guide itself.

The object of the present invention is also attained in accordance with the invention for the other type of tractor operation or tractor arrangement in the manner that the two tractors operating as pull means and the drive shaft, as well as a round bar which is parallel to the drive shaft, are fastened on two lateral bearing plates forming a removable unit therewith and that each of the two tractors can be tightly clamped to the round bar by means of a swingable tractor flap.

In this connection, it is furthermore advantageous for the tractor flap to have a slot lying in the plane of swing which converges in the closing direction and which in size is adapted to the round bar so that it forms a tight fit therearound.

BRIEF DESCRIPTION OF THE DRAWINGS

Preferred embodiments of the invention are described in further detail below and are shown in the drawings in which.

DETAILED DESCRIPTION OF THE PRESENTLY PREFERRED EMBODIMENTS

Figure 1:
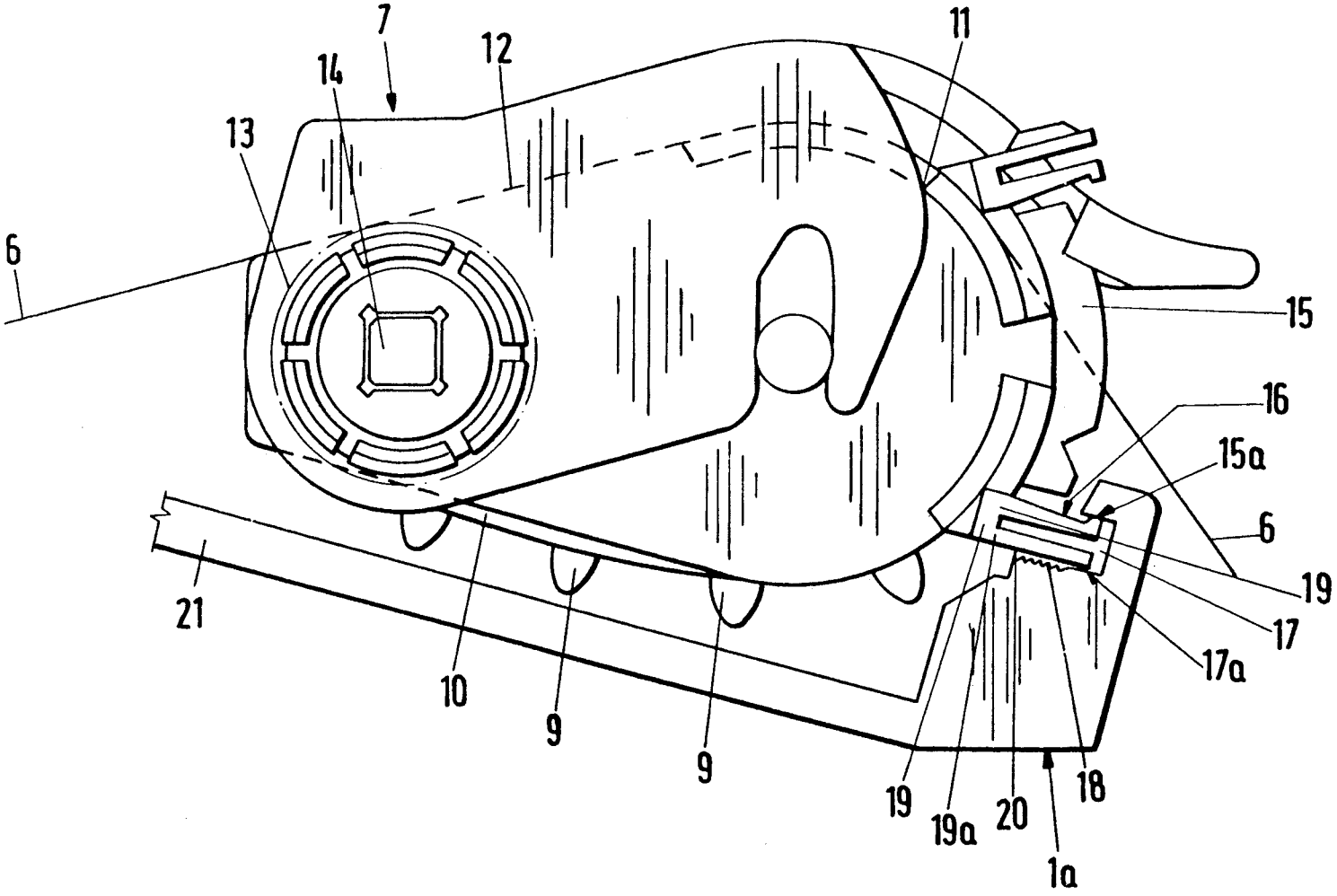
FIG. 1 is a side view of a push tractor.

The device for the transport of paper in a printer 1 (FIG. 4) with a runner guide 2 for a print head 3 and a print platen 4 has, approximately at its center, a guide roll 5 around which a continuous web 6 is conducted. The edge-perforated continuous web 6 is either pushed in by a push tractor 7 or pulled in by a pull tractor 8 or, if both are desired, a push and a pull tractor can be present. In this connection, the pins 9 of a pin belt 10 engage into the edge-perforated continuous web 6 (FIG. 1). The pin belt forms a long path for the guidance of the paper of the continuous web 6 by means of a long arcuate guide 11 (greater than 180°) and a long linear guide 12.

Irrespective of its position the tractors 7, 8 have at least one driven wheel 13 which is fixedly mounted for rotation on a polygonal drive shaft 14. In tractor 7, utilized as means for pushing the web toward the print head, each tractor frame 15 is provided with a projection 16 at the side opposite the drive shaft 14 and which releasably rests with its end 15*a* against a bottom member 21 of the printer frame 1*a* and thus prevents the tractor frame 15 from turning. Preferably the projections 16 of the two tractors 7 are held transversely displaceable in a continuous guide 17 which extends parallel to the drive shaft 14. The guide 17 is provided on its resting surface 17*a* with a plurality of parallel teeth or toothing 18 and the projections 16 comprise resilient arms 19, with a lower arm 19*a* having a tooth 20 which engages into the toothing 18 of the guide 17, the arms 19 providing resiliently interlocked engagement of the projection 16 and guide 17.

Figure 2A:
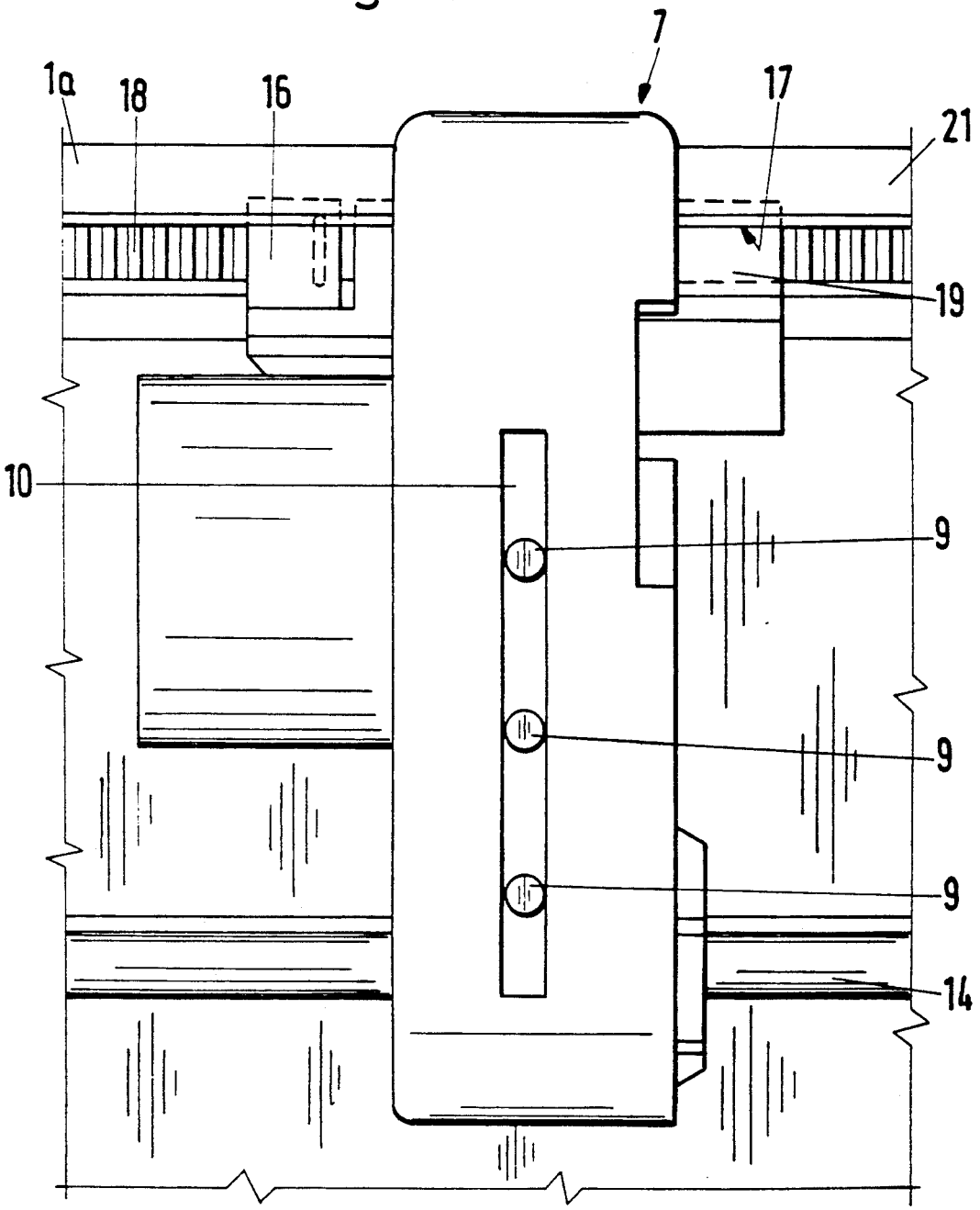
FIGS. 2*a* and 2*b* are top views of the push tractor of FIG. 1.
Figure 2B:
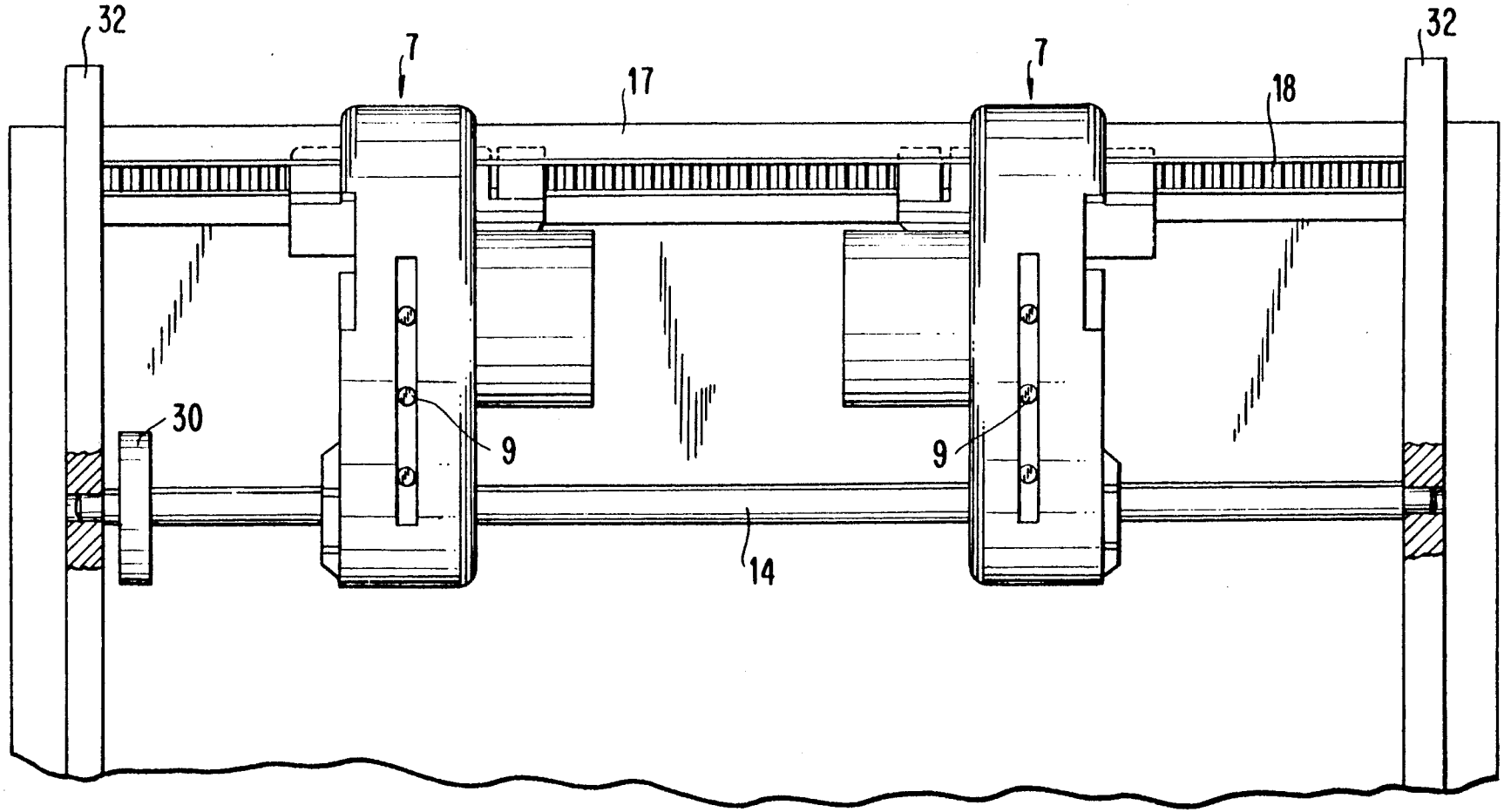

As will be readily understood by the person having ordinary skill in the art, the drive shaft 14 is mounted in lateral side plates 32 which may form part of the printer frame and is provided and driven by suitable gears 30 (FIG. 2*b*). The drive shaft has a polygonal, for example, a square cross section thereby operatively connected to wheel 13 for driven rotation thereof. The upstream end of the tractor pair 7, when viewed in the direction of movement of the continuous web, is mounted on the printer frame in the above described manner by projections 16 which are affixed to and project from tractor frame 15. Tractor pair 7 is also provided with a central opening in the same plane as the opening 31 for the drive shaft 14 but at the opposite end thereof. The opening 31 serves to receive a round bar and to mount the tractor pair when used as means for pulling the continuous web as will be further described below. In the embodiment in which the tractor pair 7 are utilized as means for pushing the continuous web, the opening is not used for mounting the tractors as the position of the tractors is fixed solely by the projections 16 which engage into guide 17 as described above.

Figure 3:
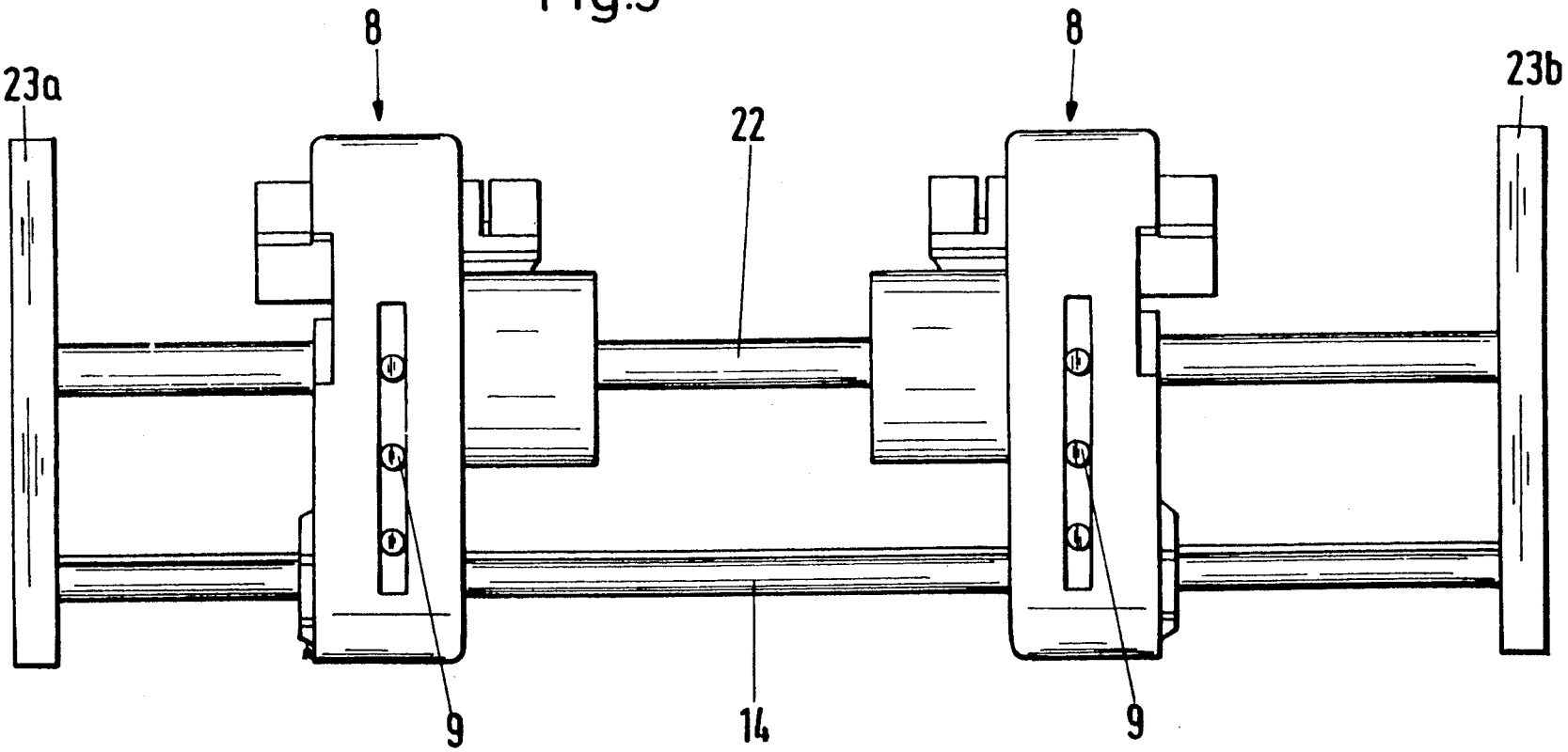
FIG. 3 is a top view of a pull tractor.
Figure 4:
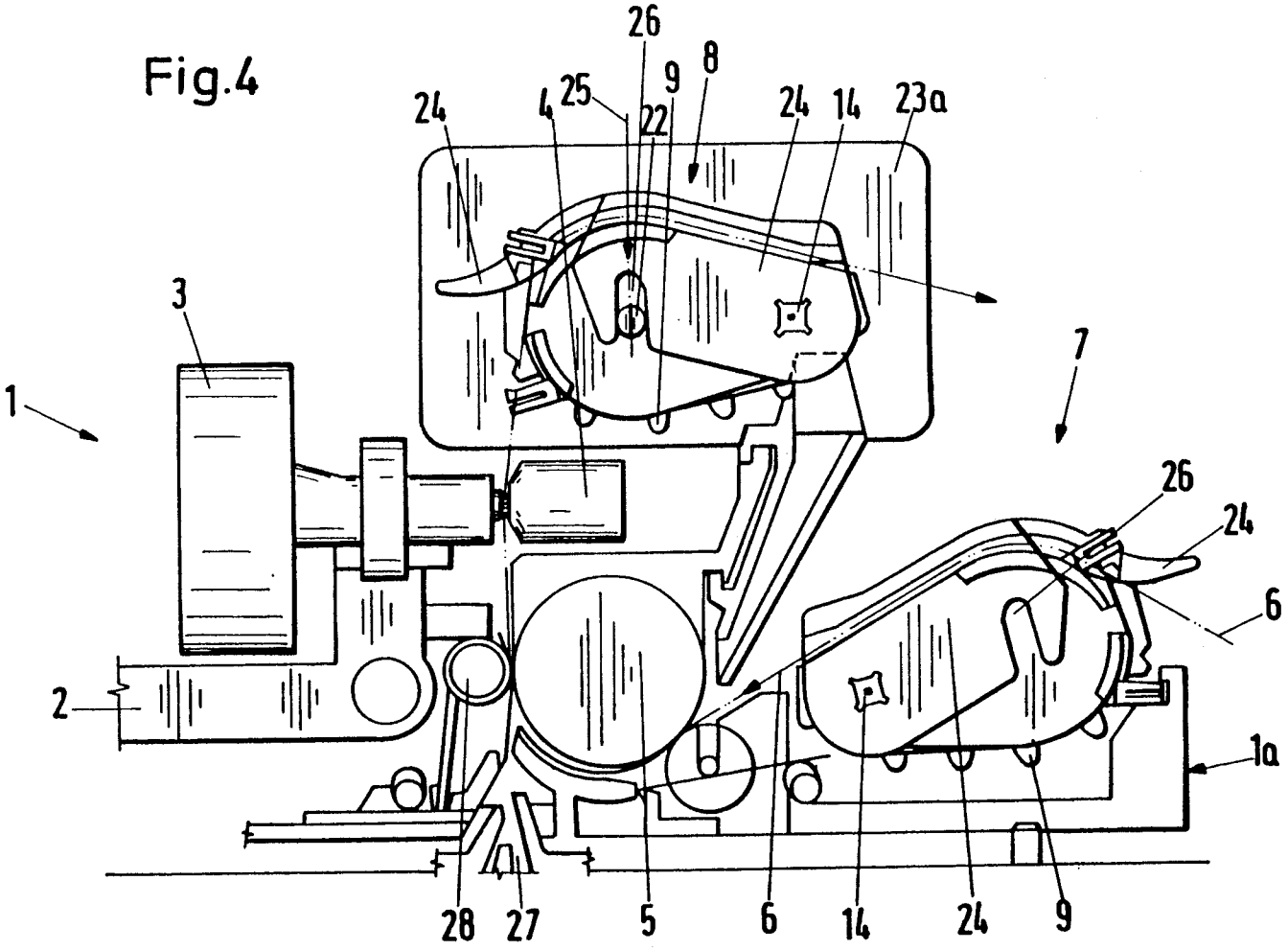
FIG. 4 is a schematic side view of the printer with pull and push tractors.

The tractors 8 in accordance with FIGS. 3 and 4 have essentially the same structure as that described in connection with tractors 7 and are also driven and held by a polygonal drive shaft 14. At the same time, the two tractors 8 also rest on a round bar 22 which extends through a respective opening 31. In FIGS. 3 and 4 round bar 22 extends through respective openings 30 in tractors 8 essentially parallel to the drive shaft 14. The drive shaft 14 and the round bar 22 are fastened or mounted for rotation in lateral bearing plates 23*a* and 23*b* and together form a unit which can be removed and easily reinserted. Lateral bearing plates 23*a* and 23*b* of the independent pull-tractor sub-assembly are mounted to the printer frame in any suitable manner known to the person skilled in the art and not shown in FIG. 4 for reasons of clarity.

The transverse displacement of the two tractors 8 to a desired width of paper web is fixed in position here by swingable tractor flaps 24. For this purpose, the tractor flap 24 has an arcuate slot 26 which lies in the plane of swing (i.e., plane of the drawing in FIG. 4) and narrows down in the closing direction 25 and is adapted to the diameter of the round bar 22 (the slot 26 remains unused in the push tractor 7).

The pull tractor 8 is particularly advantageous for multi-ply continuous webs 6 or label webs which are introduced on the printer 1 through a lower guide channel 27 and are passed between the idling guide roller 5 and one or more press rollers 28. Since the tractors 7 and 8 are completely identical to each other, the push tractor 7 also has a tractor flap 24 with slot 26 which, however, is not required here.

It should be understood that the preferred embodiments and examples described are for illustrative purposes only and are not to be construed as limiting the scope of the present invention which is properly delineated only in the appended claims.

What is claimed is:

1. An apparatus for alternate use in push-type and pull-type feeding of a continuous web in a feed direction in a printer, comprising:

a printer frame, a drive shaft supported by said printer frame, a pair of transversely displaceable tractors mounted on said fame for alternative use as one of means for push feeding said web and means for pull feeding said web, the tractors having pin belts driven by at least one driven tractor wheel, wherein when used as means for push feeding said continuous web, said tractors being mounted on said drive shaft and having a projection having a pair of arms, said projection extending from a side proximate said printer frame and opposite said drive shaft for mounting said tractors on said printer frame; and when used as means for pull feeding said continuous web, additionally comprising a round bar, two lateral bearing plates for supporting said round bar, and a swingable tractor flap on each of said tractors, said tractor flap having a hole and said drive shaft being positioned through said hole and said tractors, said drive shaft and said round bar being fastened to said bearing plates and forming a removable structural unit therewith; and each of said tractors being clamped to said round bar by said swingable tractor flap.

2. An apparatus for push feeding in printers of a continuous web in a feed direction through the push feeding apparatus, the web having edge perforations therein, comprising:

a printer frame and a drive shaft mounted on said frame;

a pair of transversely displaceable tractors arranged on said frame, said tractors comprising at least one driven tractor wheel and a pin belt supported by said tractor wheel and having a plurality of pins thereon for engagement in said edge perforations of said continuous web; each of said tractors, when operating as push feed means for said web, being mounted on said drive shaft and comprising a projection having a pair of resilient arms, said projection extending from the tractor in a direction opposite the web feed direction through the apparatus and from a side proximate said printer frame and opposite said drive shaft for engaging said printer frame so as to prevent said tractors from turning.

3. The apparatus according to claim 2, additionally comprising a continuous guide extending parallel to said drive shaft; said projection each of said tractor being held on said printer frame in said continuous guide.

4. The apparatus according to claim 2, further comprising interlocking means on at lest one of said projection and said guide for mutually interlocked releasable engagement of said projections and said guide.

5. The apparatus according to claim 4, wherein said interlocking means comprises a plurality of teeth on said guide and on each said projection resting on said guide.

6. A dual-function tractor for alternate use in the push-type feeding and pull-type feeding of a continuous web in a feed direction in a printer including a printer frame, a guide defined in the printer frame and extending substantially transverse to the feed direction, and a drive shaft rotatable for operatively driving the tractor, said tractor comprising:

a housing;

a tractor wheel in said housing for engagement with the printer drive shaft and rotatable by the drive shaft;

a pin belt driven by and about said tractor wheel for feeding of the continuous web;

a projection extending outwardly from said housing for releasable engagement with the printer frame guide for push-type feeding of the continuous web by said tractor, said projection being movable along said guide for transverse positional adjustment of said tractor for push-type feeding of the continuous web;

a throughbore defined in and through said housing for receiving therethrough an elongated positioning bar along which said tractor is adjustably movable transverse to the web feed direction for pull-type feeding of the continuous web;

a swing flap rotatively movable in a plane defined along the feed direction and about an axis for clamping said tractor about the elongated positioning bar for pull-type feeding of the continuous web;

whereby when used for push-type feeding of the continuous web said tractor is mounted to the printer only by the drive shaft and, with said projection, by the printer guide through an interlocked engagement of the projection and guide, and when used for pull-type feeding of the continuous web said tractor is mounted to the printer only by the drive shaft and, with said throughbore and swing flap, by the elongated bar of the printer which extends through said throughbore and is clamped by said swing flap.

7. The apparatus according to claim 6, further comprising interlocking means on at least one of said projection and said guide for mutually interlocked releasable engagement of said projection and said guide.

8. The apparatus according to claim 7, wherein said interlocking means comprises a plurality of teeth on said guide and on said projection resting on said guide.

9. The apparatus according to claim 6, wherein said swing flap comprises a slot lying in said plane, said slot converging towards one end thereof so as to provide a tight fit on said elongated bar when said tractor is mounted thereon.

* * * * *